US005206126A

United States Patent [19]

Shimazaki et al.

[11] Patent Number: 5,206,126

[45] Date of Patent: Apr. 27, 1993

[54] COLOR PHOTOGRAPHIC LIGHT-SENSITIVE MATERIAL OFFERING EXCELLENT HUE REPRODUCTION

[75] Inventors: Hiroshi Shimazaki; Yasushi Irie; Fumie Fukazawa, all of Hino, Japan

[73] Assignee: Konica Corporation, Tokyo, Japan

[21] Appl. No.: 829,942

[22] Filed: Feb. 3, 1992

[30] Foreign Application Priority Data

Feb. 8, 1991 [JP] Japan ..... 3-60915

[51] Int. Cl.[5] ..... G03C 1/08

[52] U.S. Cl. ..... 430/508; 430/503; 430/574; 430/588

[58] Field of Search ..... 430/508, 574, 503, 588

[56] References Cited

U.S. PATENT DOCUMENTS

| | | | |
|---|---|---|---|
| 4,010,037 | 1/1977 | Hinata et al. | 430/574 |
| 4,028,115 | 6/1977 | Hinata et al. | 430/574 |
| 4,045,230 | 8/1977 | Koitabashi et al. | 430/574 |
| 4,049,456 | 9/1977 | Koitabashi et al. | 430/574 |
| 4,307,185 | 12/1981 | Hinata et al. | 430/574 |
| 4,326,023 | 4/1982 | DeSeyn | 430/574 |
| 4,599,301 | 8/1986 | Ohashi et al. | 430/505 |
| 4,704,351 | 11/1987 | Takiguchi et al. | 430/574 |

FOREIGN PATENT DOCUMENTS

| | | | |
|---|---|---|---|
| 0438049 | 7/1991 | European Pat. Off. | 430/503 |
| 160449 | 7/1987 | Japan . | |
| 2165058 | 4/1986 | United Kingdom . | |

*Primary Examiner*—Charles L. Bowers, Jr.
*Assistant Examiner*—Geraldine Letscher
*Attorney, Agent, or Firm*—Jordan B. Bierman

[57] ABSTRACT

A silver halide color photographic light-sensitive material is provided which comprises a support having thereon a blue-sensitive silver halide emulsion layer, a green-sensitive silver halide emulsion layer and a red-sensitive silver halide emulsion layer, having a spectral sensitivity distribution such that a wavelength weight-averaged in spectral sensitivity distribution of the red-sensitive silver halide emulsion layer is within a range of 595 to 625 nm; a maximum sensitivity wavelength in spectral sensitivity distribution of the blue-sensitive silver halide emulsion layer is within a range of 415 to 470 nm; and a sensitivity of the blue-sensitive silver halide emulsion layer at 480 nm does not exceed 35% of the sensitivity at the maximum sensitivity wavelength. The color photographic material makes it possible to faithfully reproduce the hues such as purple colors and green colors.

2 Claims, No Drawings

COLOR PHOTOGRAPHIC LIGHT-SENSITIVE MATERIAL OFFERING EXCELLENT HUE REPRODUCTION

FIELD OF THE INVENTION

The present invention relates to a color photographic light-sensitive material, more specifically a color photographic light-sensitive material which offers high chromaticness and excellent hue reproduction.

BACKGROUND OF THE INVENTION

In recent years, there have been noticeable image quality improvements in silver halide multiple-layered color photographic light-sensitive materials.

Specifically, with respect to recently developed color photographic light-sensitive materials, all of the three major factors of image quality, i.e., graininess, sharpness and color reproduction have reached a fair level. For example, color prints and slide photographs obtained by users in ordinary color photography are not said to be significantly unsatisfactory.

However, with respect to one of the three factors, namely color reproduction, the traditional problem of difficulty in reproduction for some colors remains unsolved, though there have been improvements in color purity. In other words, much remains unsatisfactory as to hue reproduction. For example, the colors which reflect light with wavelengths exceeding 600 nm, i.e., purple colors such as purple and blue-purple, and green colors such as blue-green and yellow-green, are sometimes reproduced into colors by far different from the original color, which may disappoint the user.

The major factors associated with color reproduction include spectral sensitivity distribution and interlayer effect (interimage effect).

With respect to the interimage effect, the following is known. It is known that a compound which couples with the oxidation product of the color developing agent to form a development inhibitor or precursor thereof is added to a silver halide multiple-layered color photographic light-sensitive material. It is also known that an interimage effect and hence improvement in color reproduction is obtained by retarding the development of other dye-forming layers with the development inhibitor released from this DIR compound.

Also, in the case of color negative films, it is possible to obtain an effect similar to the interimage effect by using a colored coupler in an amount more than the amount to compensate the undesirable absorption.

However, when using a large amount of a colored coupler, it becomes very difficult to make a proper judgment for printing color and density correction because the minimum density of a negative film increases, which often results in print color quality degradation.

These techniques have contributed to improvements in color reproduction, especially color purity. Recently what is called diffusive DIR whose inhibitor fragment or precursor thereof has high mobility have contributed to improvements in color purity significantly. However, the interimage effect is difficult to control with respect to its direction, and is faulty in that it causes a hue change, though it improves a chroma (control of directional interimage effect is described in U.S. Pat. No. 4,725,529 and other publications).

On the other hand, with respect to spectral sensitivity, U.S. Pat. No. 3,672,898 discloses an appropriate spectral sensitivity distribution to mitigate color reproduction variation among light sources used in taking pictures.

However, this does not provide any means of improving the poor hue reproduction described above.

Also, as has been known by those skilled in the art, hue reproduction for blue-purple, purple and similar colors is improved by shifting to the shorter wavelength side the spectral sensitivity of the red-sensitive layer. This approach is disclosed in Japanese Patent Publication Open to Public Inspection (hereinafter referred to as Japanese Patent O. P. I. Publication) Nos. 20926/1978, 131937/1984 and other publications, but the methods described therein involve some shortcomings. One of them is that the hue reproduction for purple and other colors is insufficient to meet the essential requirement. Another shortcoming is that these techniques are accompanied by sensitivity reduction in the red-sensitive layer.

In Japanese Patent O. P. I. Publication No. 34541/1986, which also discloses a method based on a combination of spectral sensitivity distribution and the interimage effect, an attempt is made to improve hue reproduction for the above-mentioned colors which are difficult to reproduce using color films, and it appears effective to some extent. In a typical example of this method, it is intended to obtain an interimage effect not only from the weight-averaged wavelength of the spectral sensitivity distribution in each of the blue-, green- and red-sensitive layers as conventional but also from a wavelength other than the weight-averaged wavelength of the spectral sensitivity distribution in each color-sensitive layer.

This method appears to be effective to some extent in improving hue reproduction for some colors. However, to ensure the interimage effect, an interimage effect ensuring layer and another kind of light-sensitive silver halide are needed in addition to the blue-, green- and red-sensitive layers. In addition, increases in the amount of silver coated and the number of production processes pose a problem of high production cost, and the obtained effect is not fully satisfactory.

SUMMARY OF THE INVENTION

As stated above, in the prior art methods, an attempt to improve color reproduction with respect to hue results in red-sensitive layer desensitization. In any case, hue reproduction is unsatisfactory for some colors.

The object of the present invention is to overcome these drawbacks and provide a silver halide color photographic light-sensitive material capable of exactly reproducing the hues which have been difficult to reproduce, particularly the hues of purple colors such as purple and blue-purple and the hues of green colors such as blue-green and green without being accompanied by red-sensitive layer desensitization.

The present inventors made investigations and found that the object of the present invention described above is accomplished by the following constitution.

Accordingly, the object described above has been accomplished by a silver halide color photographic light-sensitive material having at least one blue-sensitive silver halide emulsion layer (hereinafter also referred to as "blue-sensitive layer"), at least one green-sensitive silver halide emulsion layer (hereinafter also referred to as "green-sensitive layer") and at least one red-sensitive silver halide emulsion layer (hereinafter also referred to as "red-sensitive layer") on the support, wherein the weight-averaged wavelength λR of the spectral sensitivity distribution in the red-sensitive layer falls in the range of 595 nm to 625 nm, and the maximum sensitivity wavelength λB of the blue-sensitive layer falls in the range of 415 nm to 470 nm, and the sensitivity of the blue-sensitive layer at 480 nm does not exceed 35% of the sensitivity at the maximum sensitivity wavelength λB.

The present invention is hereinafter described in more detail.

DETAILED DESCRIPTION OF THE INVENTION

In the present invention, spectral sensitivity distribution is defined as a function of wavelength wherein the light-sensitive material is exposed to spectral light between 400 nm and 700 nm at spectral intervals of several nanometers and its sensitivity is expressed as the reciprocal of the amount of exposure which provides a density of minimum density +0.7 at each wavelength.

The weight-averaged wavelength λR of the spectral sensitivity of the red-sensitive layer can be calculated using the following equation:

$$\lambda R = \frac{\int \lambda \cdot S(\lambda) d\lambda}{\int S(\lambda) d\lambda}$$

where λ = wavelength (nm),

S(λ) = spectral sensitivity distribution.

In the present invention, to obtain the above-mentioned spectral sensitivity distribution in the red-sensitive layer, any appropriate means can be used. For example, a spectral sensitizing dye can be used to obtain such a spectral sensitivity distribution. Although there is no limitation on the spectral sensitizing dyes used in each color sensitive layer, good results are obtained, for example, by using a combination of spectral sensitizing dyes shown below.

Accordingly, to make the spectral sensitivity distribution in the red-sensitive layer fall in the range described above, various means can be used, but it is preferable that the red-sensitive emulsion be spectrally sensitized with a combination of at least one kind of the sensitizing dye represented by the following Formula I and at least one kind of the sensitizing dye represented by the following Formula II or III.

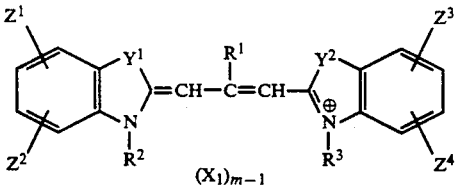

Formula I wherein $R^1$ represents a hydrogen atom, alkyl group or aryl group; $R^2$ and $R^3$ independently represent an alkyl group. $Y^1$ and $Y^2$ independently represent a sulfur atom or selenium atom.

$Z^1$, $Z^2$, $Z^3$ and $Z^4$ independently represent a hydrogen atom, halogen atom, hydroxyl group, alkoxy group, amino group, acyl group, acylamino group, acyloxy group, aryloxy group, alkoxycarbonyl group, aryloxycarbonyl group, alkoxycarbonylamino group, sulfonyl group, carbamoyl group, aryl group, alkyl group or cyano group. $Z^1$ and $Z^2$ and/or $Z^3$ and $Z^4$ respectively may bind together to form a ring. Also, $X_1$ represents a cation. m represents the integer 1 or 2; when the sensitizing dye forms an intramolecular salt, m represents 1.

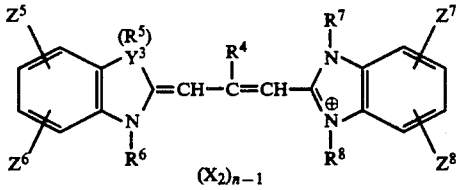

Formula II wherein $R^4$ represents a hydrogen atom, alkyl group or aryl group; $R^5$, $R^6$, $R^7$ and $R^8$ independently represent an alkyl group.

$Y^3$ represents a nitrogen atom, sulfur atom or selenium atom; when $Y^3$ is a sulfur atom or selenium atom, it does not have the above $R^5$.

$Z^5$, $Z^6$, $Z^7$ and $Z^8$ independently represent a hydrogen atom, halogen atom, hydroxyl group, alkoxy group, amino group, acyl group, acylamino group, acyloxy group, aryloxy group, alkoxycarbonyl group, aryloxycarbonyl group, alkoxycarbonylamino group, carbamoyl group, aryl group, alkyl group, cyano group, aryloxy group or sulfonyl group. $Z^5$ and $Z^6$ and/or $R^7$ and $R^8$ respectively may bind together to form a ring. Also, $X_2$ represents a cation. n represents the integer 1 or 2; when the sensitizing dye forms an intramolecular salt, n represents 1.

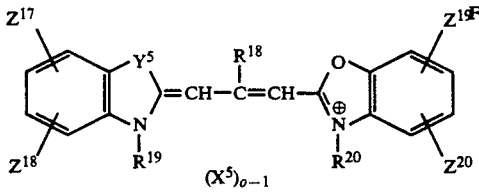

Formula III wherein $Y^5$ represents a sulfur atom or selenium atom; $R^{18}$ represents a hydrogen atom, a lower alkyl group such as methyl, ethyl or propyl or an aryl group such as a phenyl group. $R^{19}$ and $R^{20}$ independently represent a lower alkyl group (e.g., methyl, ethyl, butyl, a substituted group such as sulfoethyl, carboxypropyl or sulfobutyl). $Z^{17}$, $Z^{18}$, $Z^{19}$ and $Z^{20}$ independently represent a hydrogen atom, an atom of a halogen such as chlorine, bromine, iodine or fluorine, a hydroxyl group, an alkoxy group such as methoxy, ethoxy, propoxy or butoxy, an amino group such as amino, methylamino, dimethylamino or diethylamino, an acylamino group such as acetamide, propionamide or butylamide, an acyloxy group such as acetoxy or propionoxy, an alkoxycarbonyl group such as ethoxycarbonyl or propoxycarbonyl, an alkoxycarbonylamino group such as ethoxycarbonylamino, propoxycarbonylamino or butoxycarbonylamino or a lower alkyl group such as methyl, ethyl or propyl. $Z^{17}$, $Z^{18}$ and/or $Z^{19}$ and $Z^{20}$ respectively may bind together to form a ring. Examples of this ring include a benzene ring. $X^5$ represents a cation. Q represents the integer 1 or 2; when the sensitizing dye forms an intramolecular salt, Q represents 1.

Typical examples of the sensitizing dyes represented by Formulas I, II and III which can be used for the present invention are given below, but these are not to be construed as limitative.

The compound represented by Formula I is exemplified as follows.

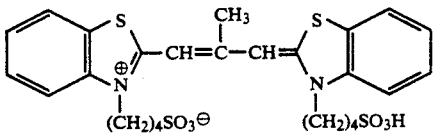
(I-1)
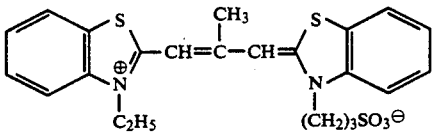
(I-2)
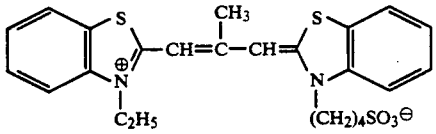
(I-3)
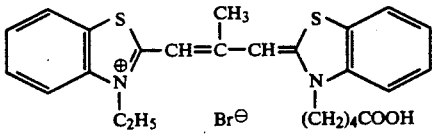
(I-4)
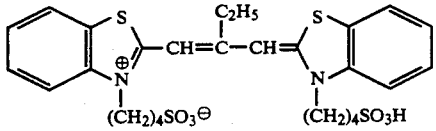
(I-5)
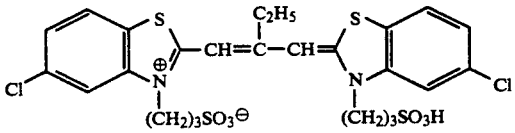
(I-6)
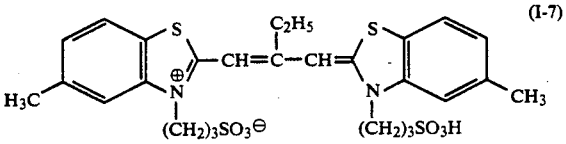
(I-7)
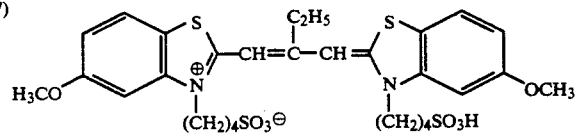
(I-8)
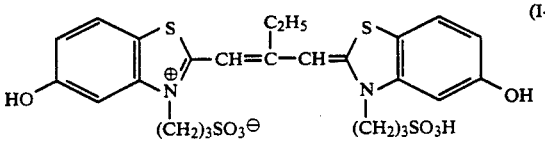
(I-9)
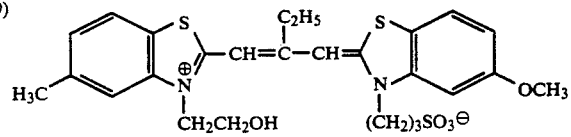
(I-10)
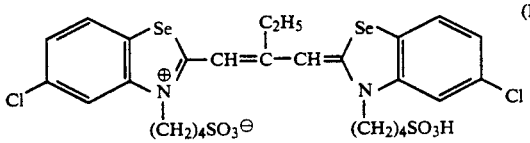
(I-11)
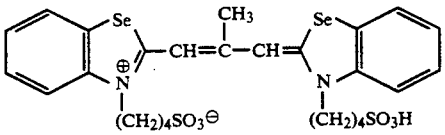
(I-12)
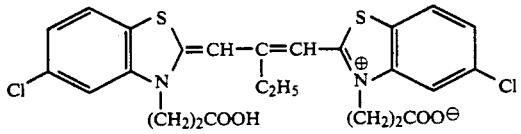
(I-13)
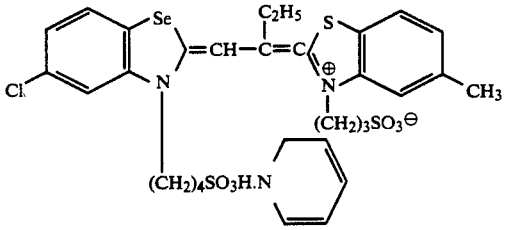
(I-14)
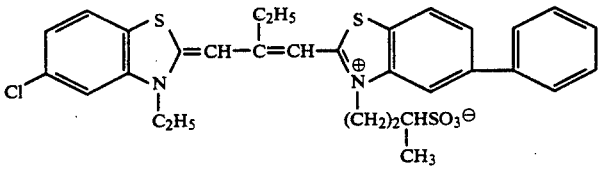
(I-15)
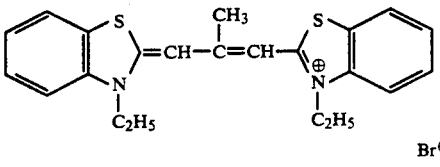
(I-16)
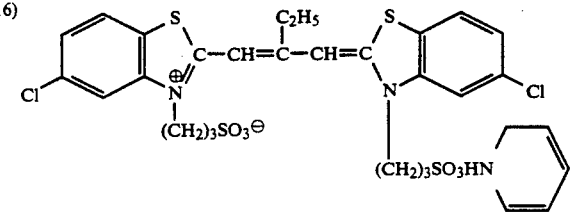
(I-17)

-continued
(I-18)
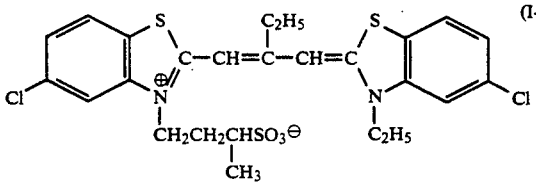
(I-19)
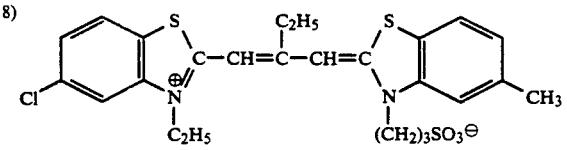
(I-20)
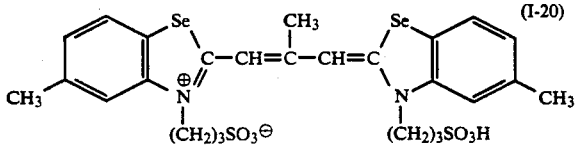
(I-21)
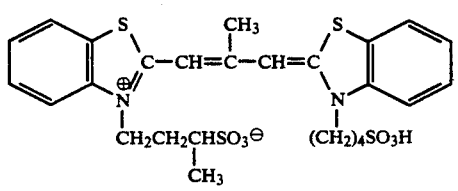
(I-22)
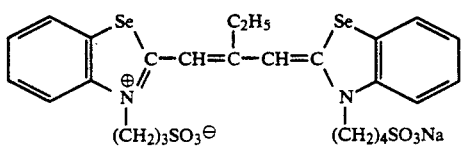
(I-23)
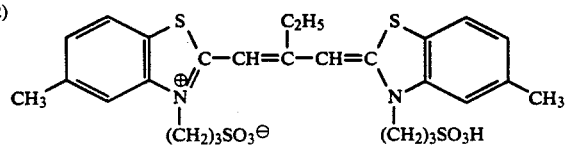
(I-24)
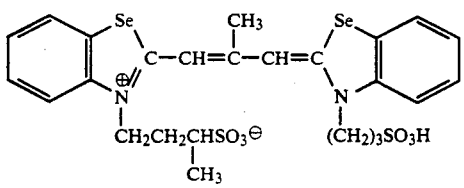
(I-25)
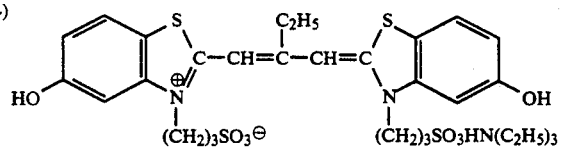
(I-26)
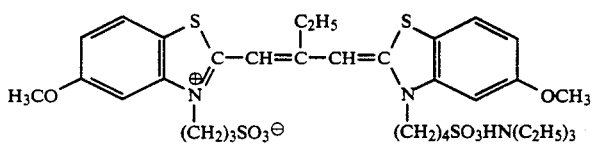
(I-27)
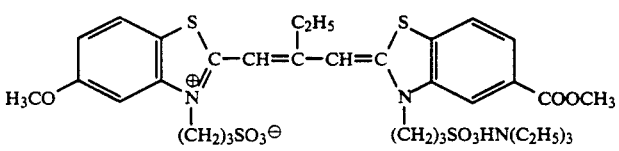
(I-28)
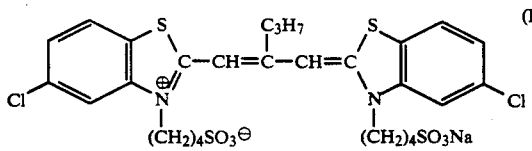
(I-29)
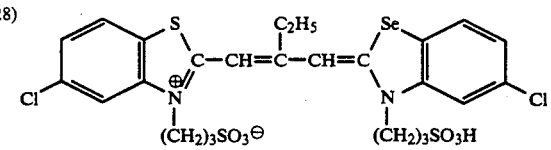
(I-30)
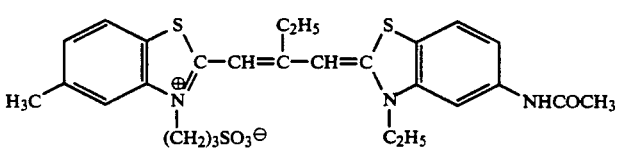
(I-31)
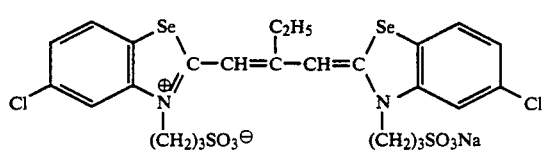

-continued
(I-32)
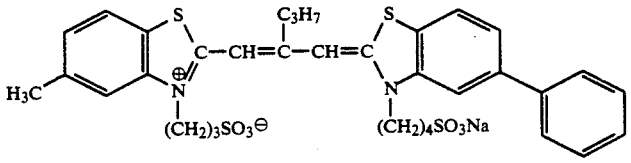
(I-33)
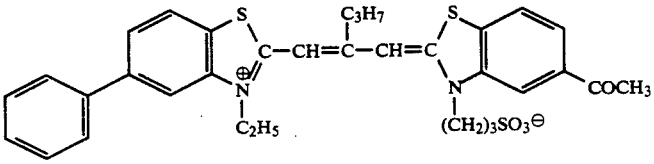
(I-34)
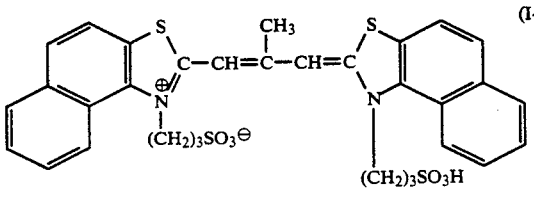
(I-35)
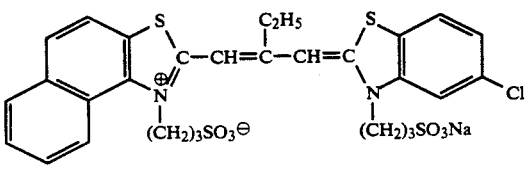
(I-36)
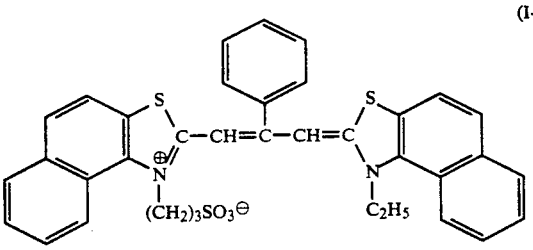
(I-37)
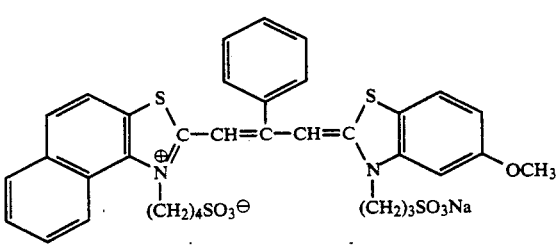
(I-38)
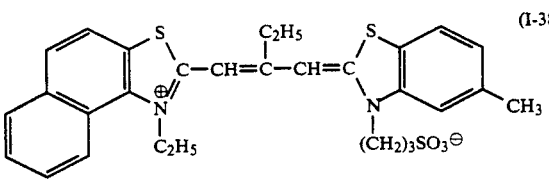
(I-39)
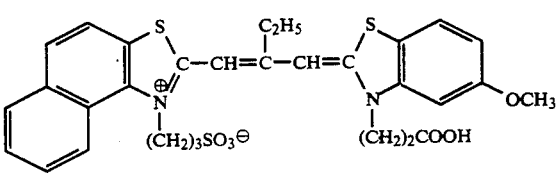
(I-40)
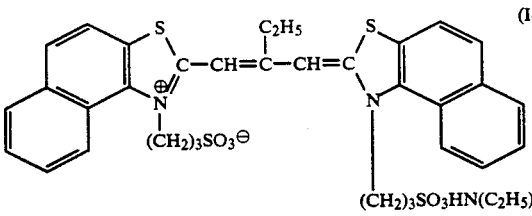
(I-41)
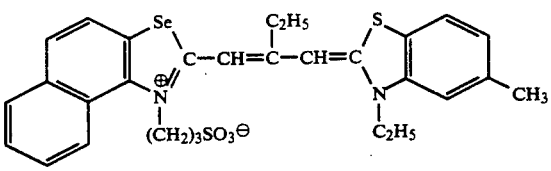
(I-42)
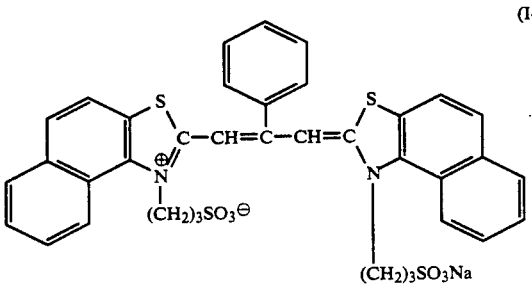
(I-43)
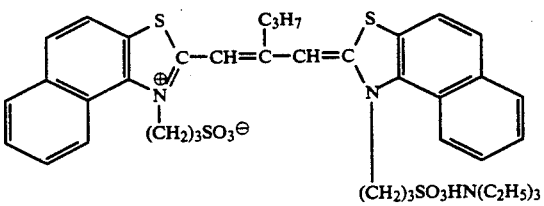

-continued
(I-44)
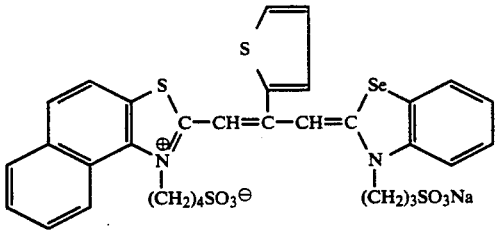
(I-45)
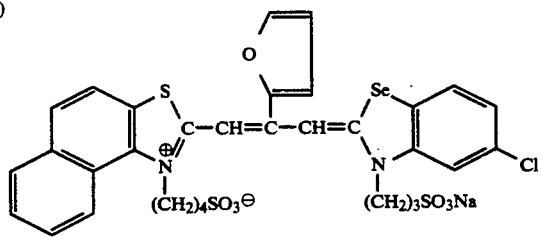
(I-46)
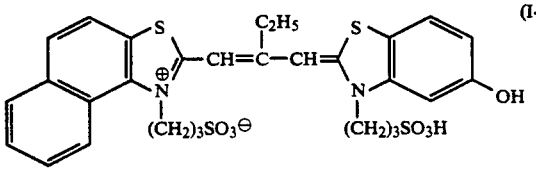
The compound represented by Formula II is exemplified as follows.
(II-1)
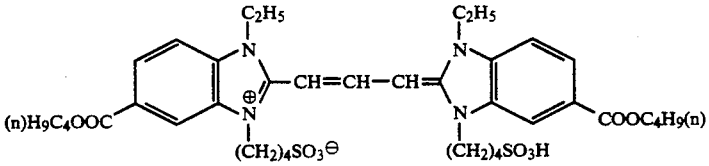
(II-2)
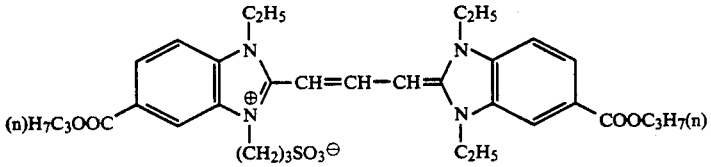
(II-3)
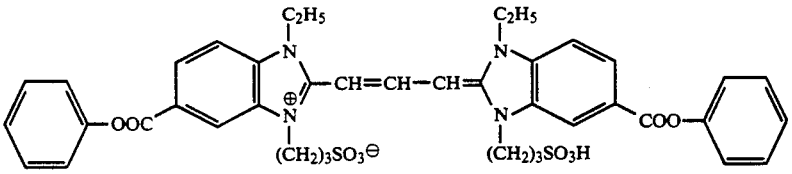
(II-4)
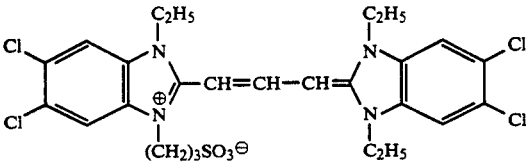
(II-5)
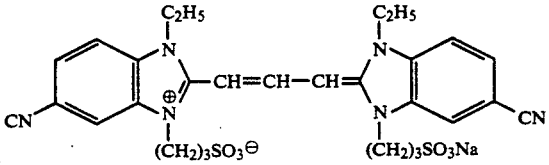
(II-6)
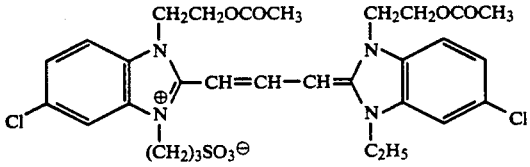

-continued
(II-7)
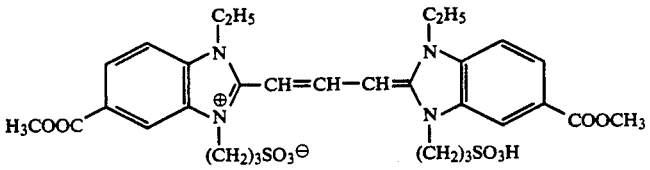
(II-8)
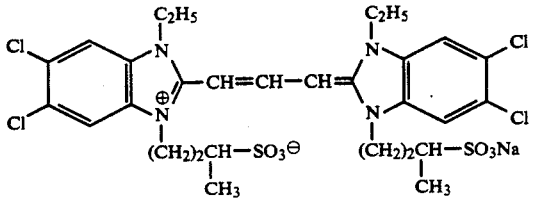
(II-9)
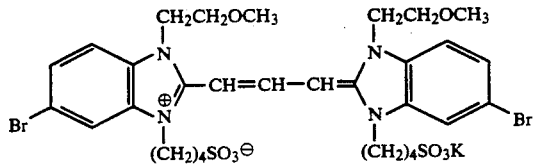
(II-10)
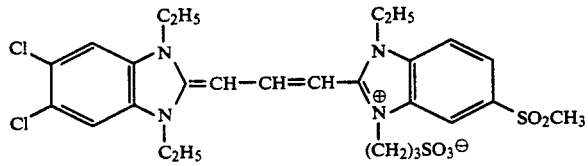
(II-11)
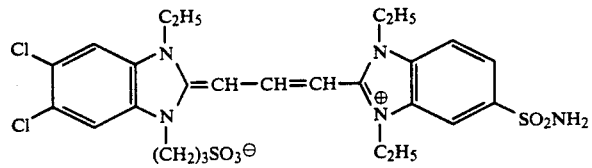
(II-12)
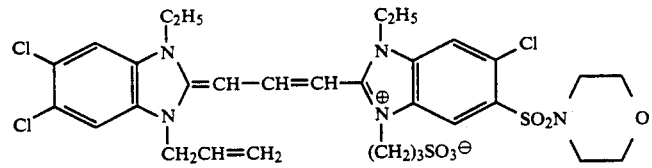
(II-13)
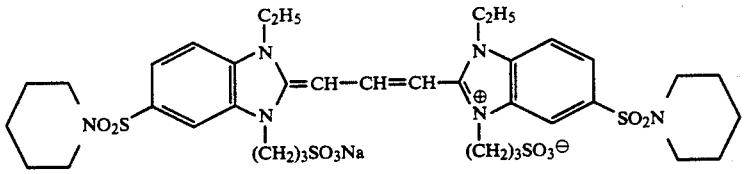
(II-14)
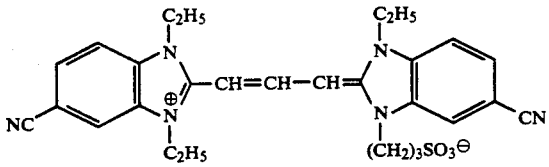
(II-15)
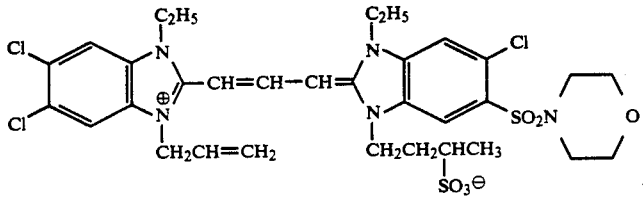

-continued
(II-16)
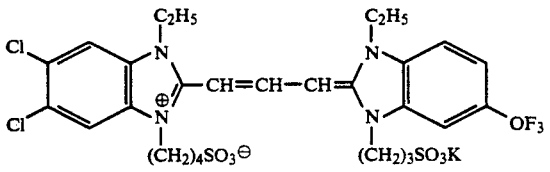
(II-17)
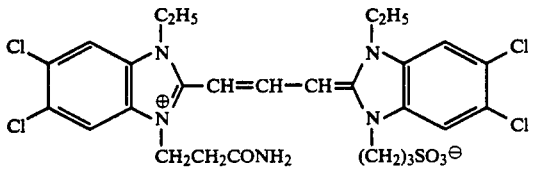
(II-18)
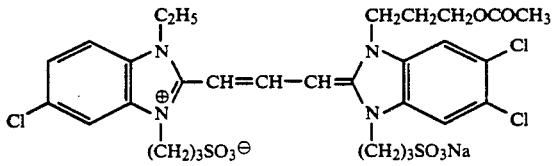
(II-19)
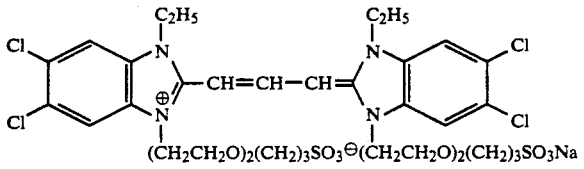
(II-20)
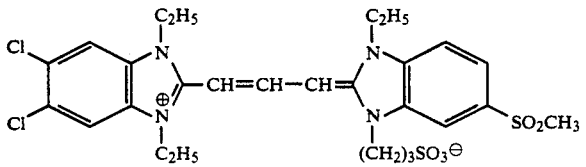
(II-21)
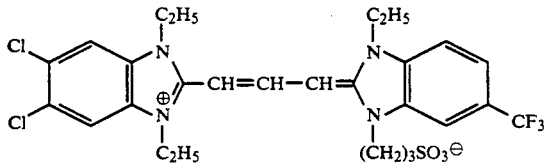
(II-22)
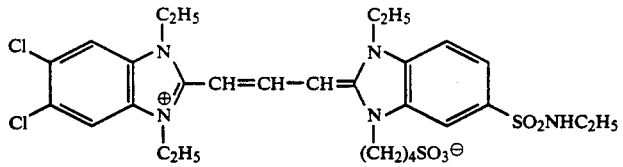
(II-23)
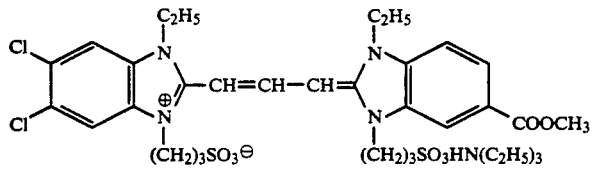
(II-24)
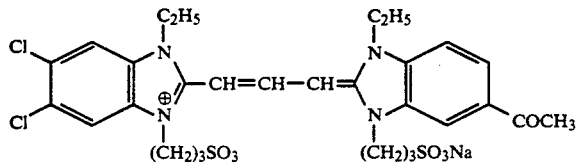

-continued
(II-25)
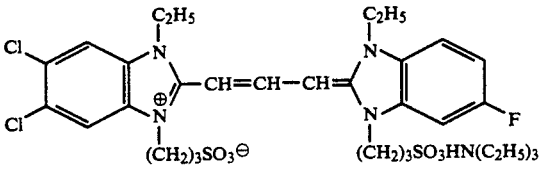
(II-26)
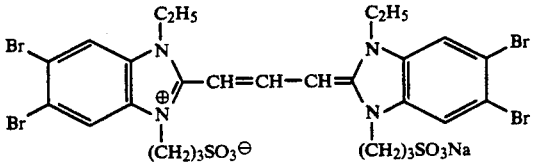
(II-27)
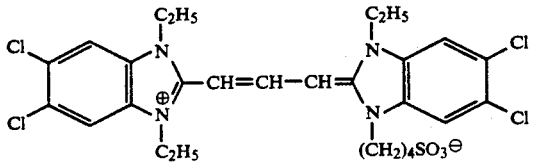
(II-28)
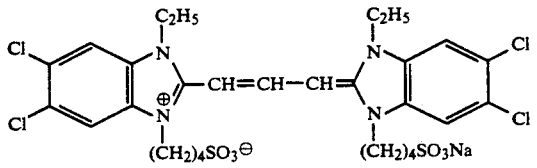
(II-29)
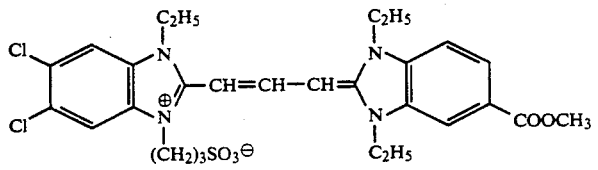
(II-30)
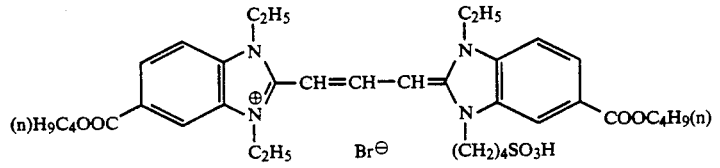
(II-31)
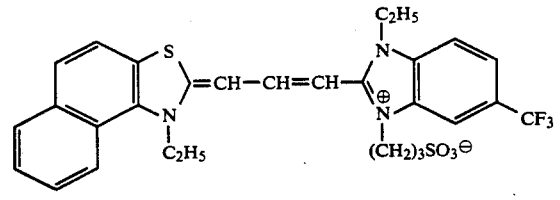
(II-32)
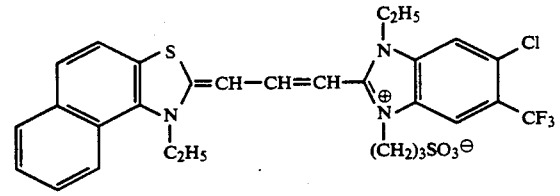
(II-33)
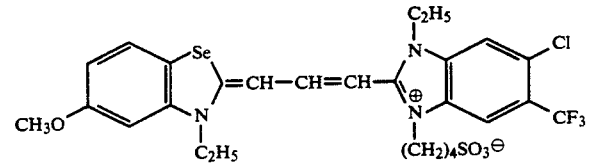

-continued
(II-34)
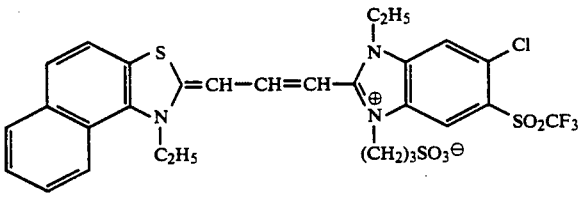
(II-35)
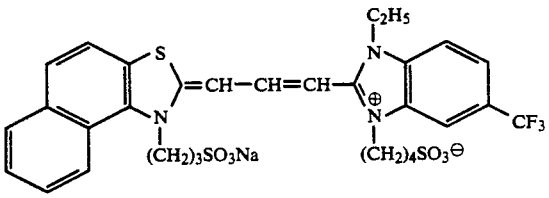
(II-36)
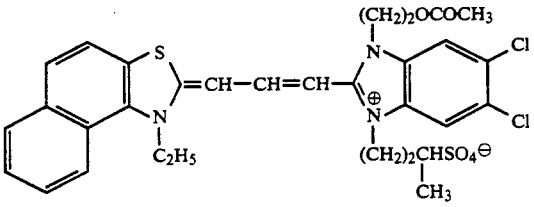
(II-37)
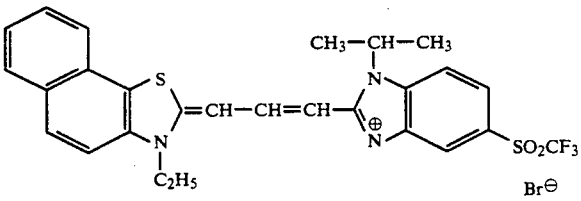
(II-38)
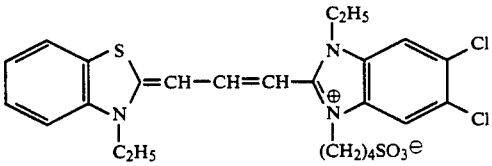
(II-39)
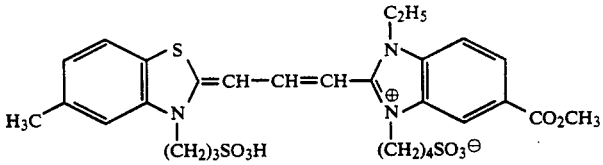
(II-40)
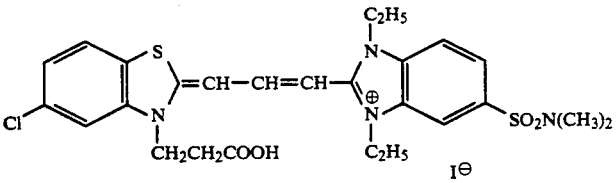
(II-41)
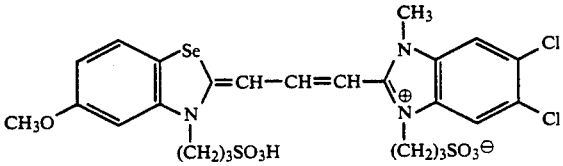

-continued
(II-42)
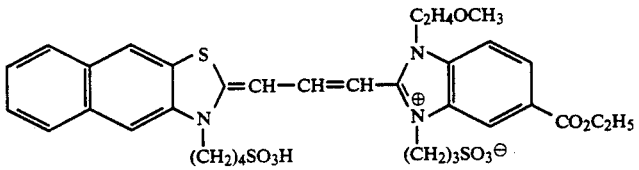
(II-43)
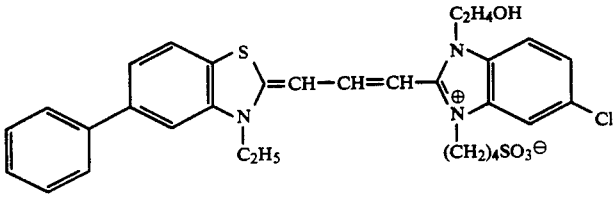
(II-44)
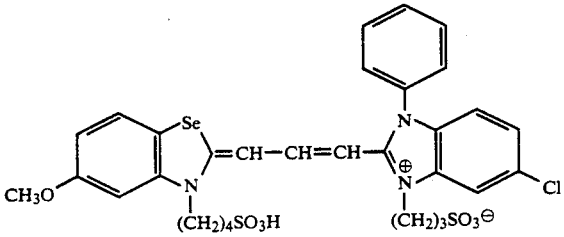
(II-45)
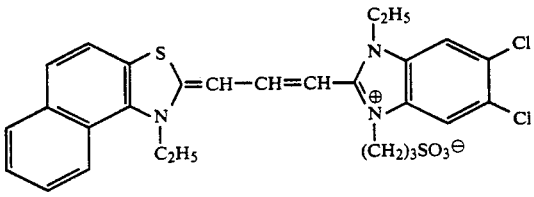
(II-46)
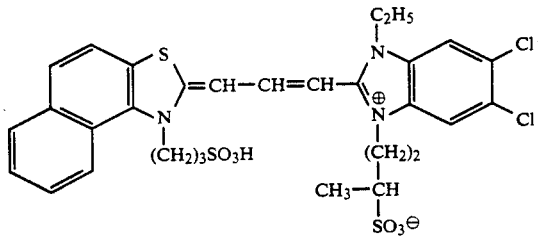
(II-47)
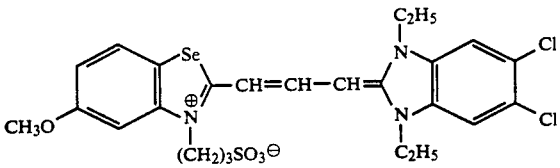
(II-48)
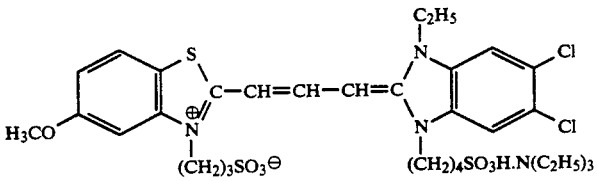
(II-49)
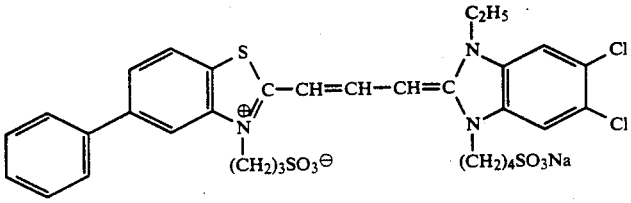

-continued
(II-50)
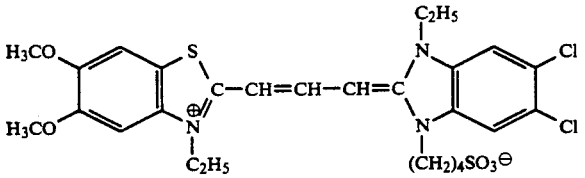
(II-51)
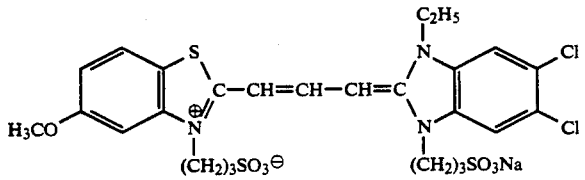
(II-52)
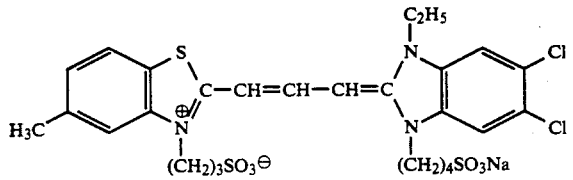
(II-53)
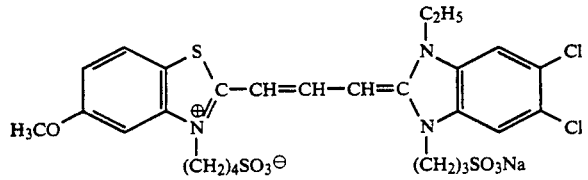
(II-54)
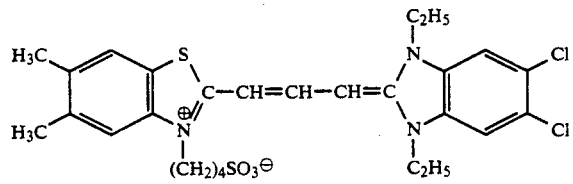
(II-55)
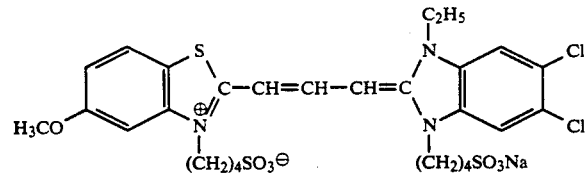
(II-56)
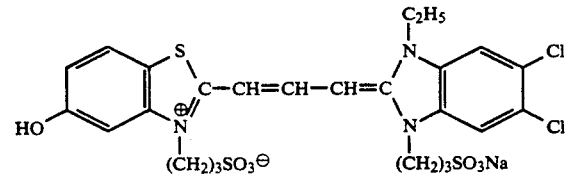
(II-57)
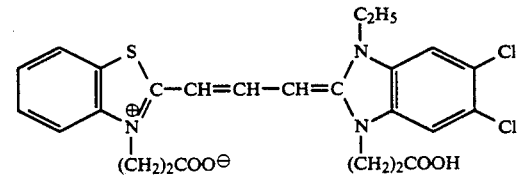

-continued
(II-58)
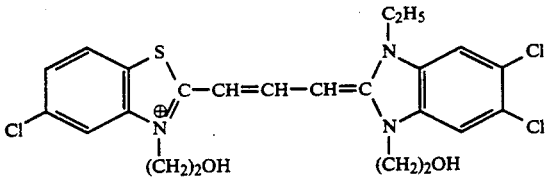
The compound represented by Formula III is exemplified as follows.
(III-1)
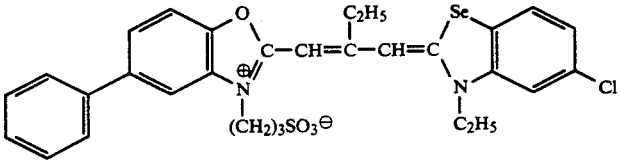
(III-2)
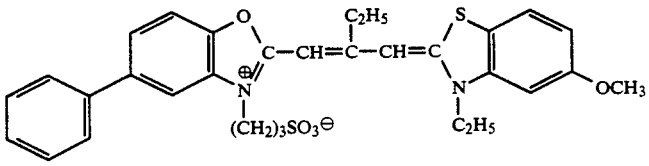
(III-3)
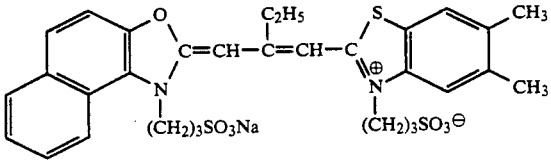
(III-4)
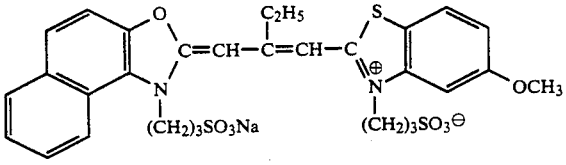
(III-5)
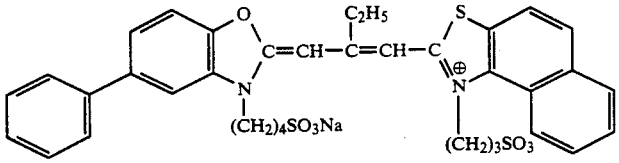
(III-6)
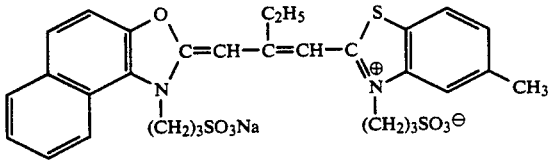
(III-7)
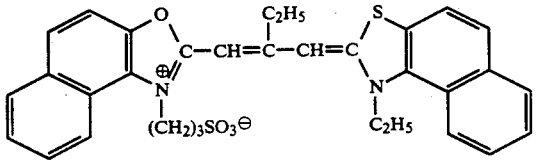

-continued (III-8)

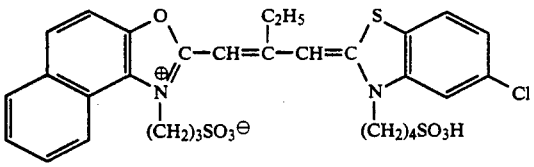

(III-9)

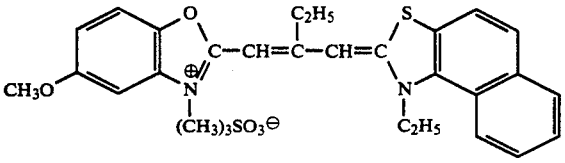

(III-10)

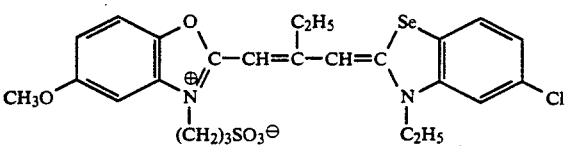

(III-11)

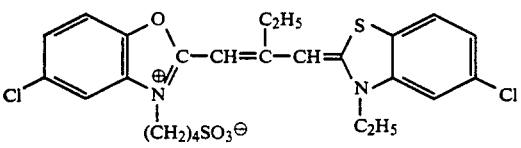

(III-12)

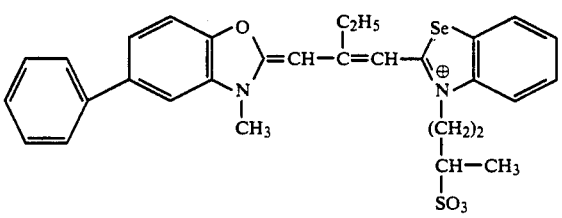

In addition to the sensitizing dyes represented by Formulas I, II and III, the benzothiazoles and quinolones described in Japanese Patent Examined Publication No. 24533/1982 and the quinoline derivatives described in Japanese Patent Examined Publication No. 24899/1982, for instance, can also be used as supersensitizers as desired.

With respect to combinations of red sensitizing dyes, it is preferable to use in combination at east one kind of the sensitizing dye represented by Formula I and at least one kind of the sensitizing dye represented by Formula II. Moreover, with respect to the structures of the sensitizing dyes used in this combination, it is preferable that $Y_1$ and $Y_2$ of the sensitizing dye represented by Formula I are sulfur and $Y_3$ of the sensitizing dye represented by Formula II is N-Ra, wherein N represents a nitrogen atom and Ra represents an alkyl group.

In the light-sensitive material of the present invention, with respect to the spectral sensitivity distribution in the blue-sensitive silver halide emulsion layer, wherein the sensitivity is defined as reciprocal of exposure necessary to give a density of minimun +0.7, it is necessary for the maximum sensitivity wavelength in the spectral sensitivity distribution to fall in the range from 415 nm to 470 nm and for the sensitivity of the blue-sensitive layer at 480 nm not to exceed 35%, preferably 25% of the maximum sensitivity of the same spectral sensitivity distribution.

To obtain the above described spectral sensitivity distribution in the blue-sensitive silver halide emulsion layer of the present invention, various means can be used. Examples of such means include the method in which a given silver halide is spectrally sensitized with a sensitizing dye having an absorption spectrum in the desired wavelength band, the method in which the desired spectral sensitivity is obtained by optimizing the halide composition and/or distribution in the silver halide grains without using a sensitizing dye, and the method in which an appropriate light absorbent is used in the light-sensitive material to obtain the desired spectral sensitivity distribution. These methods may be used in combination.

Examples of sensitizing dyes which can be used in the blue-sensitive silver halide emulsion layer of the light-sensitive material of the present invention to obtain the spectral sensitivity distribution described above are given below, but these are not to be construed as limitative.

A-1

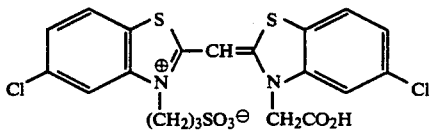

-continued

A-2

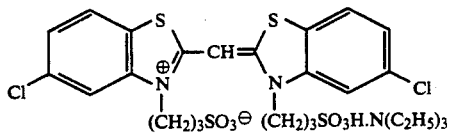

A-3

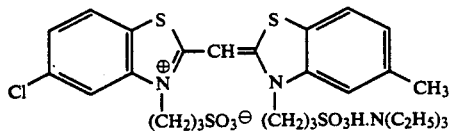

A-4

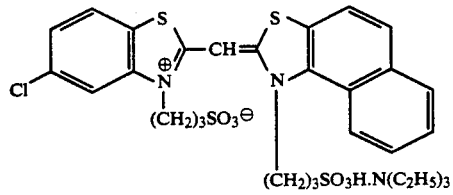

A-5

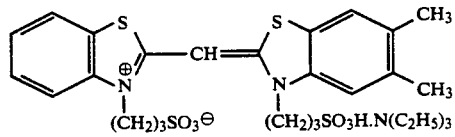

A-6

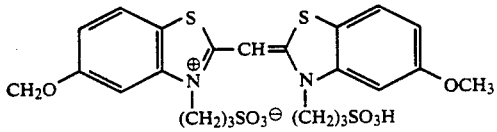

A-7

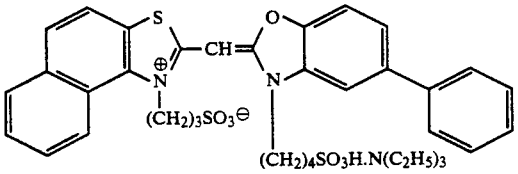

A-8

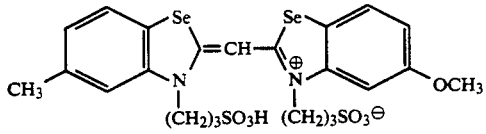

A-9

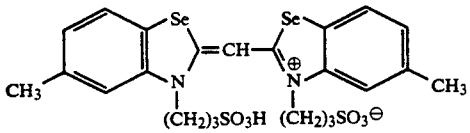

A-10

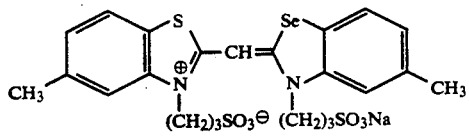

A-11

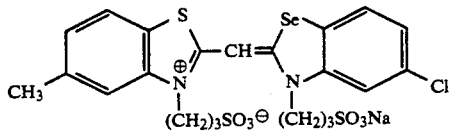

-continued

A-12

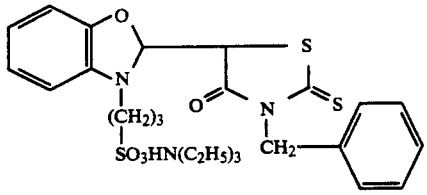

The silver halide emulsion used in the color photographic light-sensitive material of the present invention may be chemically sensitized by an ordinary method.

The silver halide emulsion may be formulated with an antifogging agent, a stabilizer and other additives. It is advantageous to use gelatin as the binder for the emulsion, though this is not to be construed as limitative.

The emulsion layer and other hydrophilic colloidal layers may be hardened, and may also contain a plasticizer, and a dispersion (latex) of a synthetic polymer which is insoluble or sparingly soluble in water.

The present invention is preferably applied to color negative films, color reversal films and so on.

The emulsion layer of the color photographic light-sensitive material of the present invention generally incorporates a color forming coupler.

It is also possible to use a colored coupler and competitive coupler for color correction, and a chemical substance which couples with the oxidation product of the developing agent and releases a photographically useful fragment such as a development accelerator, bleach accelerator, developer, silver halide solvent, toning agent, hardener, fogging agent, antifogging agent, chemical sensitizer, spectral sensitizer and desensitizer.

The light-sensitive material may be provided with an auxiliary layer such as a filter layer, anti-halation layer or anti-irradiation layer. In these layers and/or emulsion layer, a dye may be contained which oozes out from the light-sensitive material or is bleached during the developing process.

The light-sensitive material may be formulated with a formalin scavenger, brightener, matting agent, lubricant, image stabilizer, surfactant, anti-stain agent, development accelerator, development retarder and bleach accelerator.

Any substance can be used as the support such as polyethylene-laminated paper, polyethylene terephthalate films, baryta paper and cellulose triacetate.

A dye image can be obtained using the color photographic light-sensitive material of the present invention by carrying out an ordinary color photographic processing after exposure.

As stated above, the silver halide color photographic light-sensitive material of the present invention is capable of exactly reproducing hues which have conventionally been difficult to reproduce, particularly the hues of purple colors such as purple and blue-purple and the hues of green colors such as blue-green and green, without being accompanied by red-sensitive layer desensitization.

EXAMPLES

The present invention is hereinafter described in more detail by means of the following examples, but the modes of embodiment of the present invention are not limited to these examples.

In all the following examples, the amount of addition to the silver halide photographic light-sensitive material is expressed in gram per $m^2$, unless otherwise specified. Also, the amount of silver halide and colloidal silver is expressed as the amount of silver.

Example 1

Layers having the following compositions were formed on a triacetyl cellulose film support in this order from the support side to yield a multiple-layered color photographic light-sensitive material sample No. 101.

| Sample No. 101 (comparative) | |
|---|---|
| Layer 1: Anti-halation layer HC-1 | |
| Black colloidal silver | 0.20 |
| UV absorbent UV-1 | 0.20 |
| High boiling solvent Oil-1 | 0.20 |
| Gelatin | 1.5 |
| Layer 2: Interlayer IL-1 | |
| UV absorbent UV-1 | 0.04 |
| High boiling solvent Oil-1 | 0.04 |
| Gelatin | 1.2 |
| Layer 3: Low speed red-sensitive emulsion layer RL | |
| Silver iodobromide emulsion Em-1 | 0.6 |
| Sensitizing dye III-11 | $4.0 \times 10^{-4}$ (mol/mol silver) |
| Sensitizing dye I-6 4 | $0 \times 10^{-4}$ (mol/mol silver) |
| Sensitizing dye I-34 | $0.8 \times 10^{-4}$ (mol/mol silver) |
| Cyan coupler C-1 | 0.65 |
| Colored cyan coupler CC-1 | 0.12 |
| DIR compound D-1 | 0.004 |
| DIR compound D-2 | 0.04 |
| High boiling solvent Oil-1 | 0.6 |
| Gelatin | 1.5 |
| Layer 4: High speed red-sensitive emulsion layer RH | |
| Silver iodobromide emulsion Em-2 | 0.8 |
| Sensitizing dye III-11 | $2.4 \times 10^{-4}$ (mol/mol silver) |
| Sensitizing dye I-6 | $2.4 \times 10^{-4}$ (mol/mol silver) |
| Sensitizing dye I-34 | $0.2 \times 10^{-4}$ (mol/mol silver) |
| Cyan coupler C-2 | 0.13 |
| Cyan coupler C-3 | 0.02 |
| Colored cyan coupler CC-1 | 0.03 |
| DIR compound D-2 | 0.02 |
| High boiling solvent Oil-1 | 0.2 |
| Gelatin | 1.3 |
| Layer 5: Interlayer IL-2 | |
| Gelatin | 0.7 |
| Layer 6: Low speed green-sensitive emulsion layer GL | |
| Silver iodobromide emulsion Em-1 | 0.8 |
| Sensitizing dye SD-1 | $3.0 \times 10^{-4}$ (mol/mol silver) |
| Sensitizing dye SD-2 | $8.0 \times 10^{-4}$ (mol/mol silver) |
| Magenta coupler M-1 | 0.5 |
| Magenta coupler M-2 | 0.05 |
| Colored magenta coupler CM-1 | 0.1 |
| DIR compound D-3 | 0.02 |
| DIR compound D-4 | 0.005 |
| High boiling solvent Oil-2 | 0.4 |
| Gelatin | 1.0 |
| Layer 7: High speed green-sensitive emulsion layer GH | |
| Silver iodobromide emulsion Em-2 | 0.9 |
| Sensitizing dye SD-1 | $2.5 \times 10^{-4}$ (mol/mol silver) |
| Sensitizing dye SD-2 | $4.5 \times 10^{-4}$ (mol/mol silver) |
| Sensitizing dye SD-3 | $1.0 \times 10^{-4}$ (mol/mol silver) |
| Magenta coupler M-2 | 0.09 |
| Colored magenta coupler CM-2 | 0.03 |
| DIR compound D-3 | 0.05 |
| High boiling solvent Oil-2 | 0.3 |
| Gelatin | 1.0 |
| Layer 8: Yellow filter layer YC | |
| Yellow colloidal silver | 0.1 |
| Anti-color staining agent SC-1 | 0.1 |
| High boiling solvent Oil-3 | 0.1 |
| Gelatin | 0.8 |
| Layer 9: Low speed blue-sensitive emulsion layer BL | |

-continued

| Sample No. 101 (comparative) | |
|---|---|
| Silver iodobromide emulsion Em-1 | 0.5 |
| Sensitizing dye SD-5 | $6.0 \times 10^{-4}$ (mol/mol silver) |
| Yellow coupler Y-1 | 0.5 |
| Yellow coupler Y-2 | 0.2 |
| DIR compound D-2 | 0.02 |
| High boiling solvent Oil-3 | 0.3 |
| Gelatin | 1.0 |
| Layer 10: High speed blue-sensitive emulsion layer BH | |
| Silver iodobromide emulsion Em-3 | 0.55 |
| Sensitizing dye SD-5 | $3.5 \times 10^{-4}$ (mol/mol silver) |
| Yellow coupler Y-1 | 0.20 |
| High boiling solvent Oil-3 | 0.07 |
| Gelatin | 0.8 |
| Layer 11: First protective layer PRO-1 | |
| Fine grains of silver iodobromide emulsion (average grain size 0.08 μm, AgI content 2 mol %) | 0.4 |
| UV absorbent UV-1 | 0.10 |
| UV absorbent UV-2 | 0.05 |
| High boiling solvent Oil-1 | 0.1 |
| High boiling solvent Oil-4 | 0.1 |
| Formalin scavenger HS-1 | 0.5 |
| Formalin scavenger HS-2 | 0.2 |
| Gelatin | 1.0 |
| Layer 12: Second protective layer PRO-2 | |
| Alkali-soluble matting agent (average grain size 2 μm) | 0.15 |
| Polymethyl methacrylate (average grain size 3 μm) | 0.05 |
| Gelatin | 0.5 |

In addition to these compositions, coating aids Su-1 and Su-2, dispersing agents Su-3 and Su-4, hardeners H-1 and H-2, a lubricant WAX-1, a stabilizer ST-1, an antifogging agent AF-1 and two kinds of AF-2 having an average molecular weight of 10,000 or 1,100,000, respectively, were added.

The emulsions used to prepare the sample described above are as follows:

Em-1

Monodispersed (distribution width 18%) core/shell type silver iodobromide emulsion grains having an average grain size of 0.27 μm, an average silver iodide content of 7.0 mol % and an outer phase silver iodide content of 2 mol %. Distribution width=standard deviation/average grain size ×100

Em-2

Monodispersed (distribution width 18%) core/shell type silver iodobromide emulsion grains having an average grain size of 0.38 μm, an average silver iodide content of 7.0 mol % and an outer phase silver iodide content of 0.5 mol %.

Em-3

Monodispersed (distribution width 16%) core/shell type silver iodobromide emulsion grains having an average grain size of 0.45 μm, an average silver iodide content of 8.0 mol % and an outer phase silver iodide content of 1.0 mol %.

Em-4

Monodispersed (distribution width 17%) core/shell type silver iodobromide emulsion grains having an average grain size of 0.27 μm, an average silver iodide content of 3.0 mol % and an outer phase silver iodide content of 1.0 mol %.

Em-5

Monodispersed (distribution width 16%) core/shell type silver iodobromide emulsion grains having an average grain size of 0.45 μm, an average silver iodide content of 3.0 mol % and an outer phase silver iodide content of 1.0 mol %.

The compounds used to prepare the sample described above are as follows:

SD-1

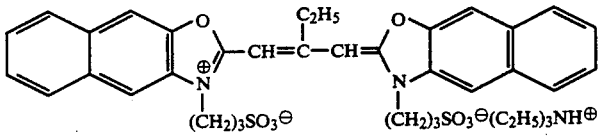

SD-2

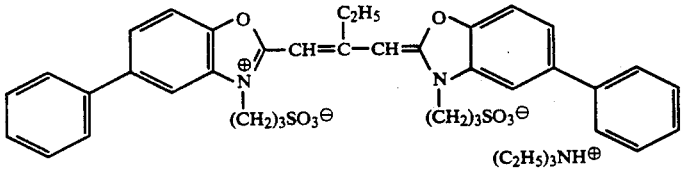

SD-3

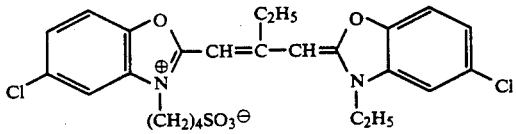

SD-4

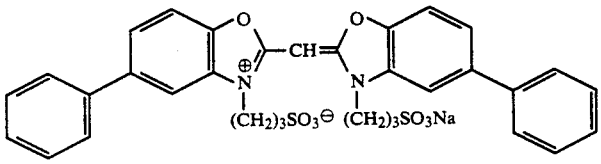

SD-5

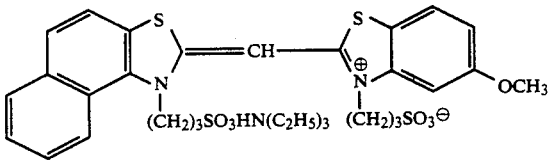

C-1

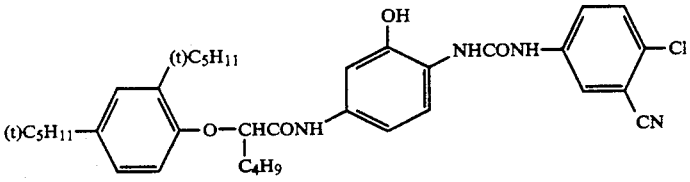

C-2

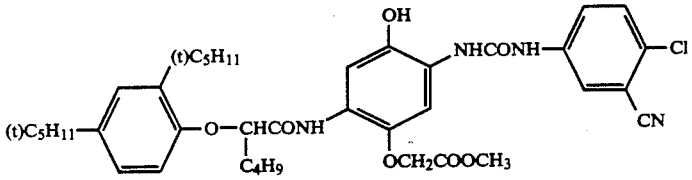

C-3

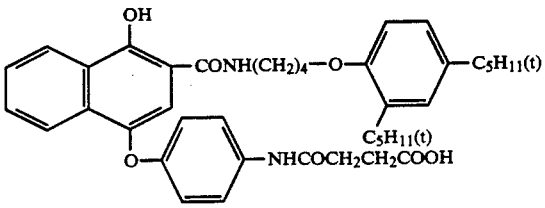

-continued
M-1
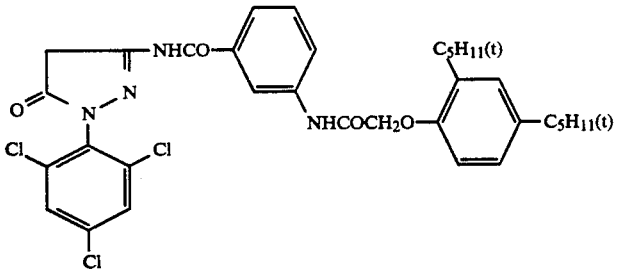
M-2
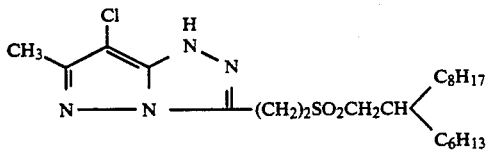
Y-1
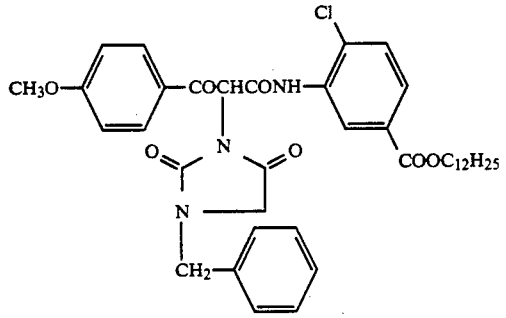
Y-1
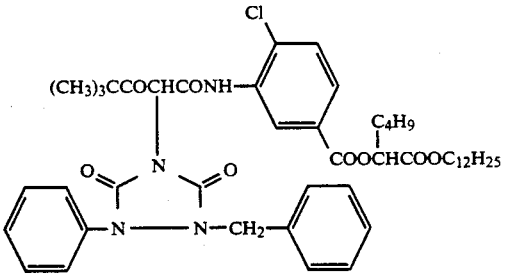
CC-1
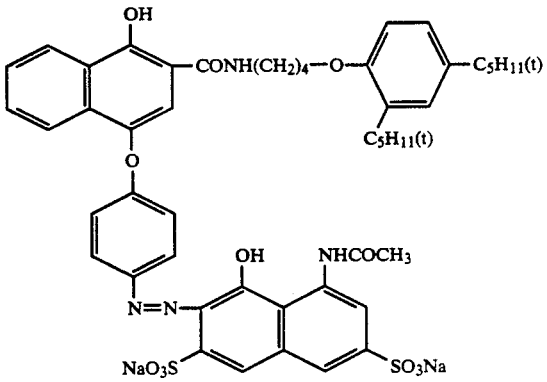

-continued
CM-1
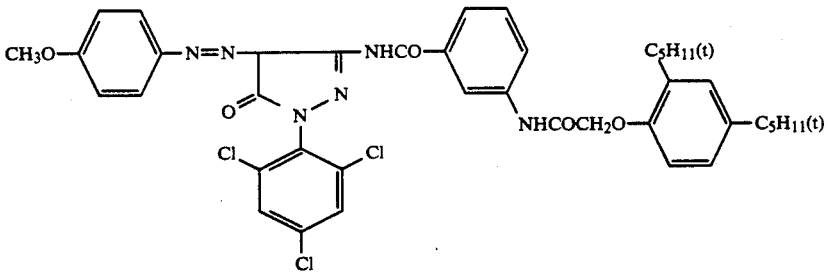
CM-2
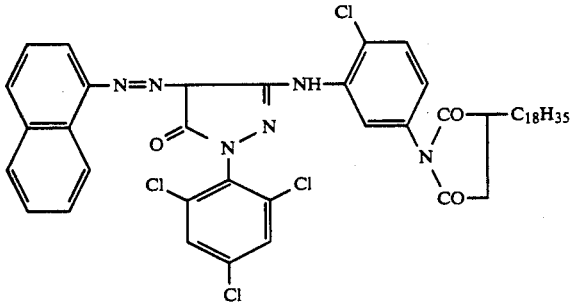
D-1
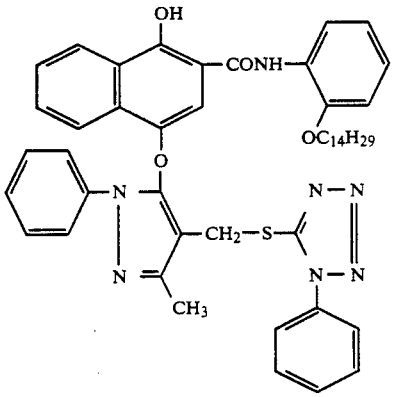
D-2
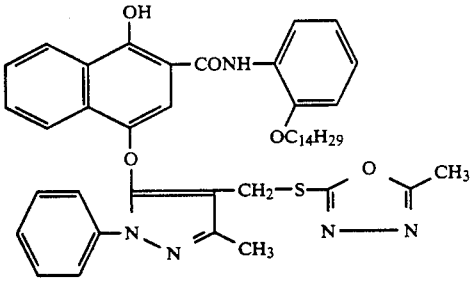
D-3
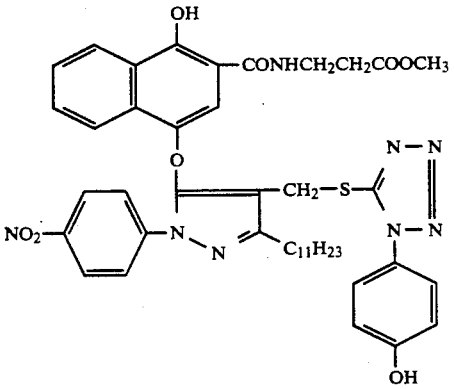

-continued
D-4
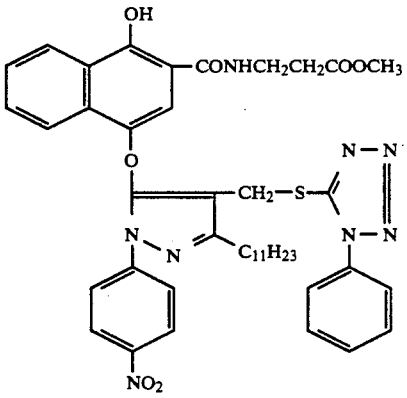
UV-1
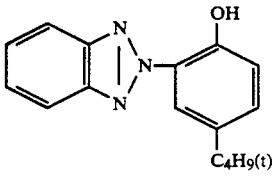
UV-2
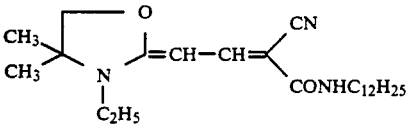
HS-1
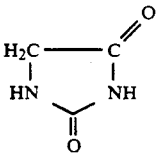
HS-2
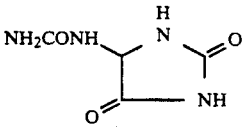
H-1
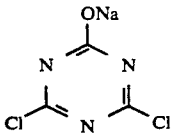
H-2
$(CH_2{=}CHSO_2CH_2)_2O$
Su-1
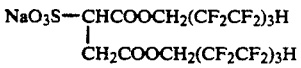
Su-2
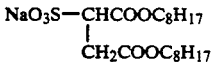
Su-3
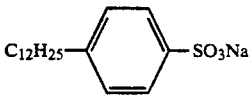

-continued
Su-4
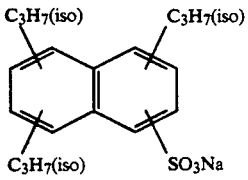
SC-1
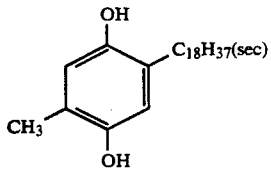
WAX-1
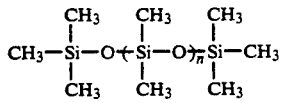
Weight average molecular weight Mw = 3,000
Oil-1
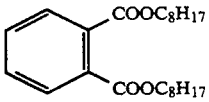
Oil-2
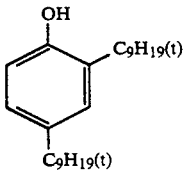
Oil-3
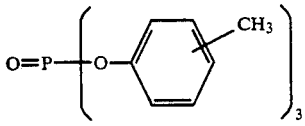
Oil-4
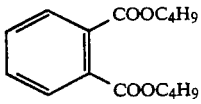
ST-1
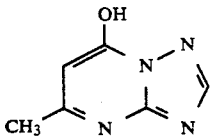
AF-1
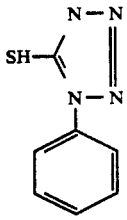
AF-2
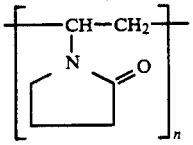
n: Degree of polymerization Sample Nos. 102 through 111 were prepared in the same manner a with sample No. 101 except that the sensitizing dyes for layers 3 and 4 and those for layers 9 and 10 were replaced with other sensitizing dyes as shown in Table 1, and that the emulsion Em-1 for layer 9 and the emulsion EM-3 for layer 10 were replaced with Em-4 and Em-5, respectively for sample No. 111.

TABLE 1

| Sample number (inventive/ comparative) | Dye number | Amount [mol/AgI mol] × $10^{-4}$ |
|---|---|---|
| Layer 3 | | |
| 101 (comparative) | (I-34) | 0.8 |
| | (I-6) | 4.0 |
| | (III-II) | 4.0 |
| 102 (comparative) | (I-34) | 0.8 |
| | (I-6) | 4.0 |
| | (III-II) | 4.0 |
| 103 (comparative) | (I-34) | 0.8 |
| | (I-6) | 8.0 |
| 104 (comparative) | (II-5) | 4.4 |
| | (III-II) | 4.4 |
| 105 (comparative) | (I-34) | 0.4 |
| | (I-6) | 1.2 |
| | (III-II) | 7.2 |
| 106 (inventive) | (I-34) | 0.4 |
| | (I-6) | 1.2 |
| | (III-II) | 7.2 |
| 107 (inventive) | (I-6) | 1.8 |
| | (III-II) | 7.0 |
| 108 (inventive) | (I-6) | 0.8 |
| | (III-II) | 7.0 |
| 109 (inventive) | (I-6) | 1.8 |
| | (II-5) | 3.5 |
| | (III-II) | 3.5 |
| 110 (inventive) | (I-6) | 1.8 |
| | (II-5) | 1.0 |
| 111 (inventive) | (I-6) | 1.8 |
| | (II-5) | 1.0 |
| Layer 4 | | |
| 101 (comparative) | (I-34) | 0.2 |
| | (I-6) | 2.4 |
| | (III-II) | 2.4 |
| 102 (comparative) | (I-34) | 0.2 |
| | (I-6) | 2.4 |
| | (III-II) | 2.4 |
| 103 (comparative) | (I-34) | 0.2 |
| | (I-6) | 4.8 |
| 104 (comparative) | (II-5) | 2.4 |
| | (III-II) | 2.6 |
| 105 (comparative) | (I-34) | 0.2 |
| | (I-6) | 0.8 |
| | (III-II) | 4.0 |
| 106 (inventive) | (I-34) | 0.2 |
| | (I-6) | 0.8 |
| | (III-II) | 4.0 |
| 107 (inventive) | (I-6) | 1.0 |
| | (II-5) | 4.0 |
| 108 (inventive) | (I-6) | 1.0 |
| | (III-II) | 4.0 |
| 109 (inventive) | (I-6) | 1.0 |
| | (II-5) | 2.0 |
| | (III-II) | 2.0 |
| 110 (inventive) | (I-6) | 1.0 |
| | (II-5) | 4.0 |
| 111 (inventive) | (I-6) | 1.0 |
| | (II-5) | 4.0 |
| Layer 9 | | |
| 101 (comparative) | (SD-5) | 6.0 |
| 102 (comparative) | (A-7) | 6.0 |
| 103 (comparative) | (SD-5) | 6.0 |
| 104 (comparative) | (A-7) | 6.0 |
| 105 (comparative) | (SD-5) | 6.0 |
| 106 (inventive) | (A-7) | 6.0 |
| 107 (inventive) | (A-7) | 6.0 |
| 108 (inventive) | (A-7) | 6.0 |
| 109 (inventive) | (A-7) | 6.0 |
| 110 (inventive) | (A-7) | 6.0 |
| 111 (inventive) | (A-7) | 6.0 |

TABLE 1-continued

| Sample number (inventive/ comparative) | Dye number | Amount [mol/AgI mol] × $10^{-4}$ |
|---|---|---|
| Layer 10 | | |
| 101 (comparative) | (SD-5) | 3.5 |
| 102 (comparative) | (A-7) | 3.5 |
| 103 (comparative) | (SD-5) | 3.5 |
| 104 (comparative) | (A-7) | 3.5 |
| 105 (comparative) | (SD-5) | 3.5 |
| 106 (inventive) | (A-7) | 3.5 |
| 107 (inventive) | (A-7) | 3.5 |
| 108 (inventive) | (A-7) | 3.5 |
| 109 (inventive) | (A-7) | 3.5 |
| 110 (inventive) | (A-1) | 3.5 |
| 111 (inventive) | (A-7) | 3.5 |

Using sample Nos. 101 through 111 thus prepared, photographs of a Macbeth color rendition chart were taken, followed by the developing process shown below.

| Processing procedures (38° C.) | |
|---|---|
| Color development | 3 minutes 15 seconds |
| Bleaching | 6 minutes 30 seconds |
| Washing | 3 minutes 15 seconds |
| Fixation | 6 minutes 30 seconds |
| Washing | 3 minutes 15 seconds |
| Stabilization | 1 minute 30 seconds |
| Drying | |

The processing solutions used in the respective processing procedures had the following compositions:

| | |
|---|---|
| Color developer | |
| 4-amino-3-methyl-N-ethyl-N-(β-hydroxyethyl) aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |
| Water was added to make a total quantity of 1 l (pH = 10.1) | |
| Bleacher | |
| Iron (III) ammonium ethylenediaminetetraacetate | 100 g |
| Diammonium ethylenediaminetetraacetate | 10.0 g |
| Ammonium bromide | 150.0 g |
| Glacial acetic acid | 10 ml |
| Water was added to make a total quantity of 1 l, and aqueous ammonia was added to obtain a pH of 6.0. | |
| Fixer | |
| Ammonium thiosulfate | 175.0 g |
| Anhydrous sodium sulfite | 8.5 g |
| Sodium metasulfite | 2.3 g |
| Water was added to make a total quantity of 1 l, and acetic acid was added to obtain a pH of 6.0. | |
| Stabilizer | |
| Formalin (37% aqueous solution) | 1.5 ml |
| Konidax (produced by Konica Corporation) | 7.5 ml |
| Water was added to make a total quantity of 1 l. | |

From the processed films thus obtained, images were printed on color paper (Konica Color PC Paper type SR) so that gray of an optical density of 0.7 was reproduced into the same density. Each reproduced color was compared with the original color on the color chart in terms of hue. Results are shown in Table 2. The wavelength which provided the maximum spectral speed for the blue-sensitive layer of each sample, the relative sensitivity at 480 nm in percent ratio to the maximum sensitivity and the weight-averaged wavelength of the spectral sensitivity in the red-sensitive layer are shown in Table 2.

Also, sample Nos. 101 through 111 were exposed to white light through an optical wedge, followed by the same developing process as above.

The sensitivity of the red-sensitive layer of sample Nos. 101 through 111 thus processed was determined. Results are shown in Table 2. Here, the sensitivity is obtained from the amount of exposure necessary to provide an optical density of minimum density +0.3 as obtained by densitometry through a red filter, expressed in percent ratio relative to the sensitivity of sample No. 101.

As seen in Table 2, with respect to the samples prepared in accordance with the present invention, the reproduced colors for purple (P), blue-purple (BP), blue-green (BG) and green (G) colors are close to the original colors without being accompanied by red-sensitive layer desensitization, demonstrating that exact hue reproduction has been achieved.

It is also evident that the hue reproduction for blue-green increases as the relative sensitivity at 480 nm decreases.

TABLE 2

| Sample number (inventive/ comparative) | Red-sensitive layer: Relative density | Red-sensitive layer: Weight-averaged wavelength λR (nm) of spectral sensitivity distribution | Blue-sensitive layer: Maximum sensitivity wavelength λB (nm) | Blue-sensitive layer: Relative sensitivity at 480 nm | Hue reproduction: Red-purple | Hue reproduction: Blue-purple | Hue reproduction: Blue-green | Hue reproduction: Green |
|---|---|---|---|---|---|---|---|---|
| 101 (comparative) | 100 | 630 | 475 | 80 | Red-purple | Purple | Blue | Blue-green |
| 102 (comparative) | 100 | 630 | 465 | 30 | Red-purple | Purple | Strongly bluish blue-green | Strongly bluish blue-green |
| 103 (comparative) | 405 | 645 | 475 | 80 | Strongly reddish red-purple | Red-purple | Blue | Blue-green |
| 104 (comparative) | 75 | 580 | 465 | 30 | Blue-purple | Very bluish blue-purple | Strongly bluish blue-green | Strongly bluish blue-green |
| 105 (comparative) | 100 | 615 | 475 | 80 | Slightly reddish purple | Blue-purple | Blue | Blue-green |
| 106 (inventive) | 100 | 615 | 465 | 30 | Purple | Blue-purple | Strongly bluish blue-green | Green |
| 107 (inventive) | 120 | 610 | 465 | 30 | Purple | Blue-purple | Strongly bluish blue-green | Green |
| 108 (inventive) | 110 | 615 | 465 | 30 | Purple | Blue-purple | Strongly bluish blue-green | Green |
| 109 (inventive) | 120 | 610 | 465 | 30 | Purple | Blue-purple | Strongly bluish blue-green | Green |
| 110 (inventive) | 120 | 610 | 470 | 35 | Purple | Blue-purple | Strongly bluish blue-green | Green |
| 111 (inventive) | 120 | 610 | 455 | 20 | Purple | Blue-purple | Blue-green | Green |

What is claimed is:

1. A silver halide color photographic light-sensitive material comprising a support having thereon a blue-sensitive silver halide emulsion layer, a green-sensitive silver halide emulsion layer and a red-sensitive silver halide emulsion layer, wherein a wavelength weight-averaged in spectral sensitivity distribution of said red-sensitive silver halide emulsion layer is within a range of 595 to 625 nm; a maximum sensitivity wavelength in spectral sensitivity distribution of said blue-sensitive silver halide emulsion layer is within a range of 415 to 470 nm; and a sensitivity of said blue-sensitive silver halide emulsion layer at 480 nm is not more than 35% of the sensitivity at said maximum sensitivity wavelength.

2. The photographic material of claim 1, wherein said red-sensitive silver halide emulsion layer comprises a sensitizing dye represented by the following formula I and a sensitizing dye represented by the following formula II or III:

formula I

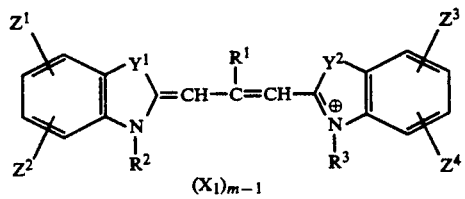

wherein $R^1$ represents a hydrogen atom, alkyl group or aryl group; $R^2$ and $R^3$ independently represent an alkyl group; $Y^1$ and $Y^2$ independently represent a sulfur atom or selenium atom; $Z^1$, $Z^2$, $Z^3$ and $Z^4$ independently represent a hydroxy group, hydroxy group, alkoxy group, amino group, acyl group, acylamino group, acyloxy group, aryloxy group, alkoxycarbonyl group, aryloxycarbonyl group, alkoxycarbonylamino group, sulfonyl group, carbamoyl group, aryl group, alkyl group or cyano group; $Z^1$ and $Z^2$, or $Z^3$ and $Z^4$ may bind together to form a ring; $X_1$ represents a cation; m is an integer of 1 or 2, provided that when the sensitizing dye forms an intramolecular salt, m is 2, formula II

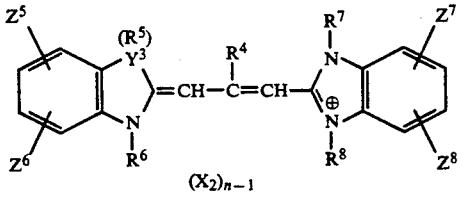

wherein $R^4$ represents a hydrogen atom, alkyl group or aryl group; $R^5$, $R^6$, $R^7$ and $R^8$ independently represent an alkyl group; $Y^3$ represents a nitrogen atom, sulfur atom or selenium atom, provided that when $Y^3$ is a sulfur atom or selenium atom, it does not have the above $R^5$; $Z^5$, $Z^6$, $Z^7$ and $Z^8$ independently represent a hydrogen atom, halogen atom, hydroxy group alkoxy group, amino group, acyl group, acylamino group, acyloxy group, aryloxy group, alkoxycarbonyl group, aryloxycarbonyl group, alkoxycarbonylamino group, carbamoyl group, aryl group, alkyl group, cyano group, aryloxy group or sulfonyl group; $Z^5$ and $Z^6$, or $Z^7$ and $Z^8$ may bind together to form a ring; $X_2$ represents a cation; n is an integer of 1 or 2, provided that when the sensitizing dye forms an intramolecular salt, n is 1, formula III

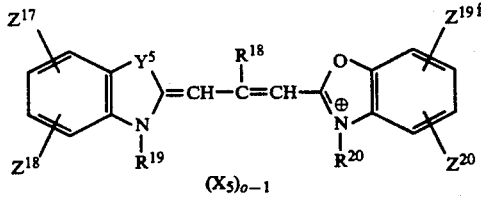

wherein $Y^5$ represents a sulfur atom or selenium atom; $R^{18}$ represents a hydrogen atom, alkyl group or aryl group; $R^{19}$ and $R^{20}$ independently represent an alkyl group; $Z^{17}$, $Z^{18}$, $Z^{19}$ and $Z^{20}$ independently represent a hydrogen atom, halogen atom, hydroxy group, an alkoxy group, amino group, acylamino group, acyloxy group, alkoxycarbonyl group, alkoxycarbonylamino group or alkyl group; $Z^{17}$ and $Z^{18}$, or $Z^{19}$ and $Z^{20}$ may bind together to form a ring; $X_5$ represents a cation; and Q is an integer of 1 or 2, provided that when the sensitizing dye forms an intramolecular salt, Q is 1.

* * * * *